US007324060B2

(12) United States Patent
Quan et al.

(10) Patent No.: US 7,324,060 B2
(45) Date of Patent: Jan. 29, 2008

(54) POWER DIVIDER HAVING UNEQUAL POWER DIVISION AND ANTENNA ARRAY FEED NETWORK USING SUCH UNEQUAL POWER DIVIDERS

(75) Inventors: Clifton Quan, Arcadia, CA (US); Stephen M. Schiller, La Mirada, CA (US); Yanmin Zhang, Cerritos, CA (US)

(73) Assignee: Raytheon Company, Waltham, MA (US)

( * ) Notice: Subject to any disclaimer, the term of this patent is extended or adjusted under 35 U.S.C. 154(b) by 103 days.

(21) Appl. No.: 11/217,801

(22) Filed: Sep. 1, 2005

(65) Prior Publication Data

US 2007/0046393 A1 Mar. 1, 2007

(51) Int. Cl.
*H01Q 21/22* (2006.01)
*H01P 5/12* (2006.01)

(52) U.S. Cl. ..... 343/853; 333/125; 333/128

(58) Field of Classification Search ..... 333/125, 333/128, 136, 117; 343/853
See application file for complete search history.

(56) References Cited

U.S. PATENT DOCUMENTS 2,836,798 A * 5/1958 Levine ..... 333/128
3,091,743 A 5/1963 Wilkinson
3,742,392 A * 6/1973 Schwarzmann ..... 333/128
4,328,471 A * 5/1982 Quine ..... 333/128
4,450,418 A * 5/1984 Yum et al. ..... 333/128
5,204,643 A 4/1993 Verronen
5,506,589 A 4/1996 Quan et al.
6,657,514 B1 12/2003 Tokudera et al.
6,756,859 B2 * 6/2004 Kodim ..... 333/101

OTHER PUBLICATIONS

Jong-Sik, Lim et al: "a 4 : 1 Unequal Wilkinson Power Divider" IEE Microwave and Wirelss Componants. vol. 11, No. 3, Mar. 2001 XP011038704.
Ahn H R et all: "General design equations of three-port unequal power-dividers terminated by arbitrary impedances" Microwave Symposium Digest 2000 IEEE, vol. 2. XP 0105075.
J. Read and G.J. Wheller, "A Method of Analysis of Symmetrical Four Port Network", IRE Trans. MTT, vol. MTT-4, pp. 246-252, Oct. 1956.
L.I. Parad and R.L. Moyniham, "Split-Tee Power Divider", IEEE Trans. MTT, vol. MTT-13, pp. 91-95, Jan. 1965.

* cited by examiner

*Primary Examiner*—Benny T. Lee
(74) *Attorney, Agent, or Firm*—Leonard A. Alkov

(57) ABSTRACT

An RF power divider circuit unequally divides an input signal into first and second signal components of unequal power. The circuit includes a single input port, first and second output ports, and a combination of a plurality of quarter wave transformers and a plurality of resistors coupled between the input port and the first and second output ports.

18 Claims, 6 Drawing Sheets

POWER DIVIDER HAVING UNEQUAL POWER DIVISION AND ANTENNA ARRAY FEED NETWORK USING SUCH UNEQUAL POWER DIVIDERS

BACKGROUND OF THE DISCLOSURE

Corporate fed RF antenna arrays or sub-arrays have a tapered amplitude distribution across the array. Such antennas, for example antennas with small arrays or small sub-arrays and/or antennas with low side-lobes, can require an amplitude distribution with tapers, or power split ratios, in excess of 3 dB and as high as or higher than 8 dB. Some antennas use Wilkinson power dividers to split the power among elements of an array. Some Wilkinson power divider arrangements may not exceed a 3 dB power split and/or may have degraded performance at power split ratios in excess of 3 dB.

SUMMARY

An RF power divider circuit unequally divides an input signal into first and second signal components of unequal power. The circuit includes a single input port, first and second output ports, and a combination of a plurality of quarter wave transformers and a plurality of resistors coupled between the input port and the first and second output ports. In an exemplary embodiment, the plurality of quarter wave transformers include a dielectric substrate and a conductor strip pattern formed on the dielectric substrate.

BRIEF DESCRIPTION OF THE DRAWINGS

Features and advantages of the disclosure will readily be appreciated by persons skilled in the art from the following detailed description of exemplary embodiments thereof, as illustrated in the accompanying drawings, in which.

DETAILED DESCRIPTION OF THE DISCLOSURE

Figure 1:
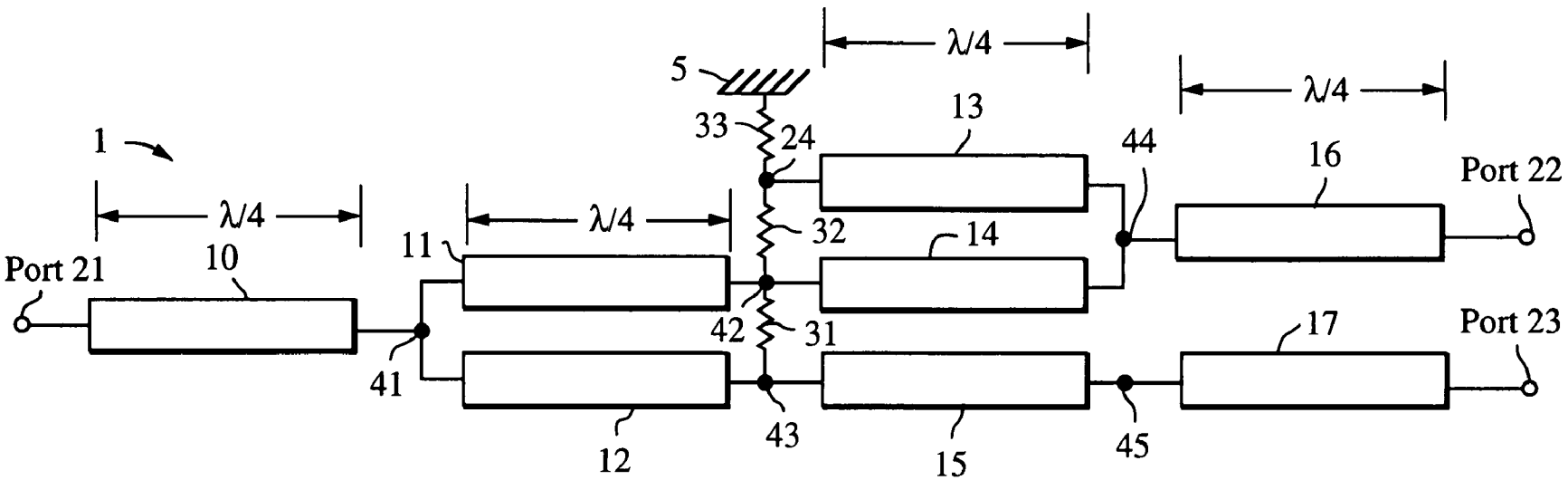
FIG. 1 illustrates a schematic diagram of an exemplary embodiment of a power divider.

In the following detailed description and in the several figures of the drawing, like elements are identified with like reference numerals.

FIG. 1 illustrates a schematic circuit diagram of an exemplary embodiment of an unequal power divider 1. The power divider 1 may include three input/output (I/O) ports 21, 22 and 23, port 24, resistors 31, 32 and 33, transmission line segments 10, 11, 12, 13, 14, 15, 16 and 17, and circuit nodes 41, 42, 43, 44 and 45. In an exemplary embodiment, port 21 is an input port, ports 22 and 23 are output ports with unequal power splits and port 24 is terminated through a resistor 33 to ground 5. In an exemplary embodiment, the circuit may be reciprocal in operation, and may act as an unequal power combiner circuit for combining unequally input signals applied at the two ports 22 and 23 into a single output signal at port 21.

In an exemplary embodiment, the transmission line segments 10-17 of FIG. 1 act as respective quarter wave transformers, with effective electrical lengths of $\lambda/4$, where $\lambda$ is a wavelength corresponding to a nominal operating frequency or a center frequency of a range of nominal or desired operating frequencies. A quarter wave transformer is a length of transmission line, of length equivalent to one-quarter wavelength at an operating frequency, functioning to transform a first impedance at a first end of the transformer into a second impedance at the second end of the transformer. The characteristic impedance of the transmission line of the transformer is equal to the square root of the product of the first impedance and the second impedance. Quarter wave transformers are described, for example, in "Foundation for Microwave Engineering," R. E. Collin, McGraw-Hill, 1966, Chapter five.

In exemplary embodiment, resistive element 31 is connected between node 43 and node 42, resistive element 32 is connected between node 42 and node 24, and resistive element 33 is connected between node 24 and ground 5.

In an exemplary embodiment, the resistive elements 31-33 may comprise discrete chip resistors, which may be mounted on a dielectric substrate using a solder or conductive epoxy, or printed resistors and/or may comprise thin film or thick film resistors. In an exemplary embodiment, a thick film resistor may be screen printed onto a substrate or board. In an exemplary embodiment, a thick film resistor may comprise a polymer thick film resistive paste. An exemplary thick film paste may be available from DUPONT.

In an exemplary embodiment, a discrete thin film resistor may be deposited across a copper layer pattern fabricated on a dielectric substrate or board 2 (FIGS. 3A-3F). In an exemplary embodiment, a copper layer formed on the substrate may be etched to form a conductor pattern 18 (FIGS. 3A-3F) using photolithographic techniques, and excess resistor material may be etched to form the resistive elements 31, 32, 33. In an exemplary embodiment, the dielectric substrate may be a ceramic.

The embodiment of FIG. 1 may be viewed as integrating a distributed transmission line network with a Wilkinson divider circuit portion. The Wilkinson divider circuit portion is made up of transmission line segments 10, 11, 12, 14 and 15, resistor 31, and nodes 41, 42 and 43; the outputs of the Wilkinson divider circuit portion are the outputs of transmission line segments 15, 16. The distributed transmission network comprising transmission line segments 13, 16 and 17, resistors 32 and 33, and circuit nodes 24, 44 and 45 may function in an exemplary embodiment as an attenuator, but overcomes tight tolerance resistor requirements by utilizing the network to siphon off excess power to a separate load, in this embodiment resistor 33.

In an exemplary embodiment, the required resistor values may be fabricated to a tolerance of +/−20 percent to achieve the desired power split ratio within desired tolerances which may be, for example, about +/−0.1 dB for up to about a 9 dB power split ratio, or about 1% of the desired power split ratio. The use of resistors with a tolerance of +/−20 percent to achieve desired performance may avoid additional, time-consuming, more-costly process steps, such as laser trimming, which may otherwise be taken to provide a resistor within a closer resistance-value tolerance.

In an exemplary embodiment, the impedances required for a desired power split may be calculated using equations similar to those used in the case of Wilkinson power divider with unequal power splits. In an exemplary embodiment, the impedances of the various impedance segments may be related according to the following equations ($Z_n$ represents the characteristic impedance of a transmission line segment impedance for n=10-17, as represented in FIG. 1):

If a given, desired power split ratio (power output at port 23 (P23))/(power output at port 22 (P22)) equals $k^2(k^2+1)$ ($k^2$=(power input at node 42 (P42))/(power input at node 43 (P43)):

then: $Z_{10}=Z_{16}=Z_0(1/(1+k^2)^{1/4}$ $Z_{11}=Z_{14}=Z_0k^{3/4}(1+k^2)^{1/4}$ $Z_{12}=Z_0(1+k^2)^{1/4}/k^{3/4}$ $Z_{15}=Z_0^{1/4}(Z_n/k)^{3/4}$ $Z_{17}=Z_0^{3/4}(Z_n/k)^{1/4}$ Resistor 31 ($R_{31}$)=Resistor 32 ($R_{32}$)=$Z_0(1+k^2)/k$ Resistor 33 ($R_{33}$)=$Z_0/k$ For an exemplary power divider with transmission line segments fabricated on a substrate with a thickness of 10 mils, with a dielectric coefficient ($\epsilon_r$) of 2.17, the transmission line segments may have the following widths: a line segment with a characteristic impedance $Z_0$=50 ohm has a width of 29.3 mils; transmission line segments 10 and 16 (FIG. 1) have characteristic impedances $Z_{10}=Z_{16}$=42 ohm and widths of 38.1 mils; transmission line segments 11 and 14 (FIG. 1) have characteristic impedances $Z_{11}=Z_{14}$=76.63 ohm and widths=13.6 mils; transmission line segments 12 and 14 have characteristic impedances $Z_{12}=Z_{13}$=47.37 ohm and widths=31.9 mils; transmission line segment 15 has a characteristic impedance $Z_{15}$=41.1 ohm and a width=38.5 mils; transmission line segment 10 has a characteristic impedance $Z_{10}$=47.0 ohm and a width=32.2 mils. In this exemplary embodiment, a power divider may have a 6.27 dB power split ratio (($P_{23}/P_{22}$)dB), may have $k^2$=1.618 and ($k^2$)dB=2.089 dB.

An exemplary embodiment of the power divider 1 may provide a wide-band, precision matched, in-phase power divider 1 with a power split ratio in excess of 3 dB and up to as much as 8 to 9 dB power split ratio. In an exemplary embodiment, the desired power split ratio may be achieved with loosely controlled resistor values (with a tolerance in a range of about +/−20 percent) across a wide frequency band up to 40 GHz. Of course, the frequency bandwidth and power split ratio may depend on the parameters of a particular implementation.

In an exemplary embodiment, the power divider of FIG. 1 may provide a passive technique for providing uneven power feed network 71 for an antenna array 70 (FIG. 4), which may be a low sidelobe antenna array. In an exemplary embodiment, the power divider may be used to provide a matched RF corporate feed with an amplitude distribution required for wide band/low side-lobe antenna array. In an exemplary embodiment, the power divider may be used in a low-side-lobe multi-beam antenna panel antenna for an Intelligence, Surveillance and Reconnaissance (ISR) platform.

Figure 2:
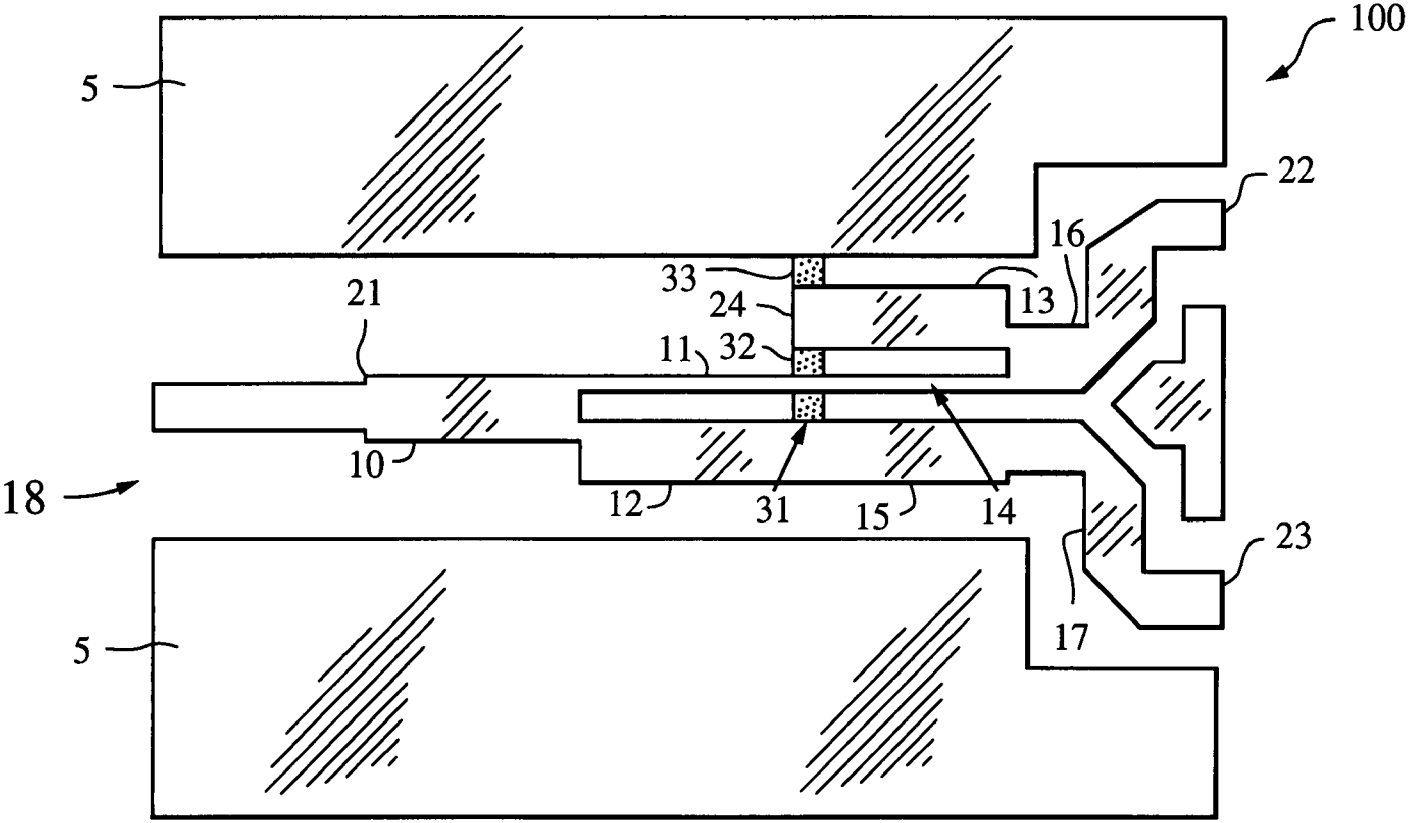
FIG. 2 illustrates a plan view of an exemplary transmission strip layout of an exemplary embodiment of the power divider of FIG. 1.

FIG. 2 illustrates a top view of an exemplary power divider circuit implementation 100 corresponding to the schematic circuit diagram of FIG. 1. The transmission strip segments identified by the reference numbers n in FIG. 2 correspond to the transmission line segments illustrated in FIG. 1. FIG. 2 illustrates a conductor pattern 18 with transmission line segments labeled with reference numbers corresponding to the reference numbers in the schematic diagram of FIG. 1. In an exemplary embodiment, the conductor pattern 18 may include three ports 21, 22 and 23, three resistors 31, 32 and 33, ground-plane portions 5 and transmission line segment portions 10, 11, 12, 13, 14, 15, 16 and 17. In exemplary embodiments, the conductor pattern 18 may be implemented in microstrip or stripline, e.g. formed by printed circuit board techniques, including, for example using a copper-cladded circuit board and using a mask to etch the strip pattern and groundplane.

In an exemplary embodiment, the circuit board 2 (FIGS. 3A-3F) may comprise DUROID™ which may be available from ROGERS Corp., or other suitable circuit board material such as, for example, ceramic, TEFLON™-based polyamides, polyesters, cyanide-esters, liquid crystal polymers (LCP), alumina, quartz, and/or aluminum nitrite.

Referring again to FIG. 2, in an exemplary embodiment the dimensions and trace width and thickness of the strip pattern 18 and transmission line segments 10-17 may be determined by the desired impedances, desired operating frequency, frequency range, and the application in which the divider may be used.

Figure 3A:
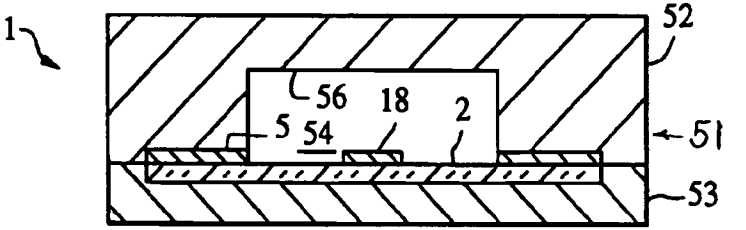
FIGS. 3A-3F illustrate simplified diagrammatic cross-sectional views of exemplary transmission line configurations.
Figure 3B:
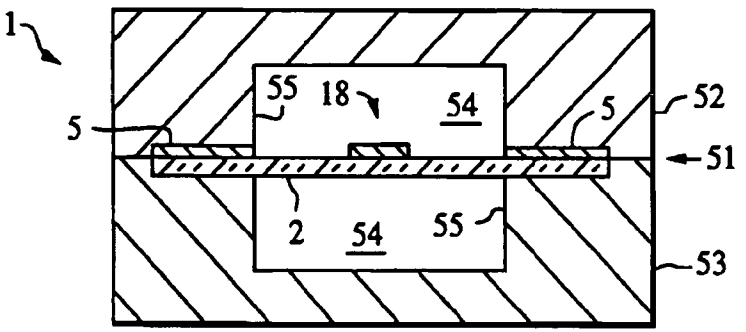
Figure 3C:
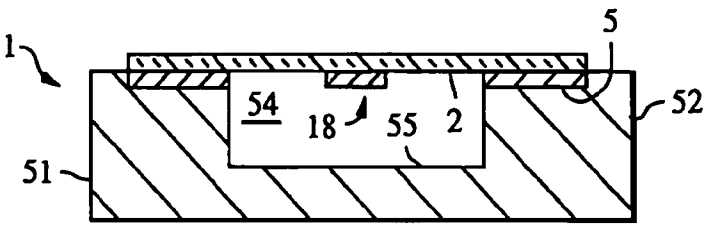
Figure 3D:
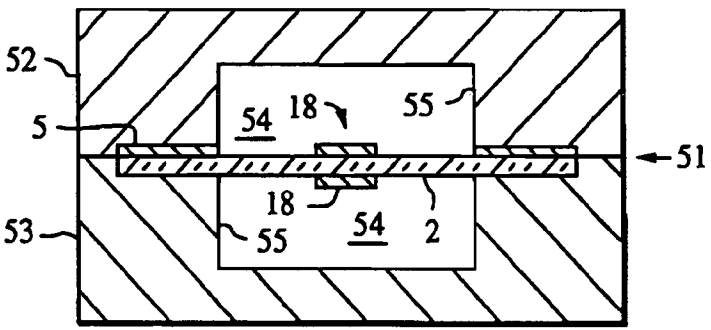
Figure 3E:
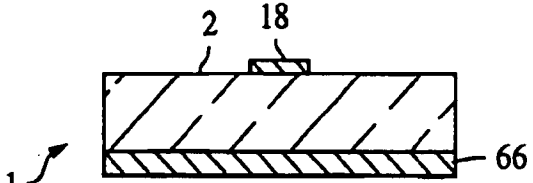
Figure 3F:
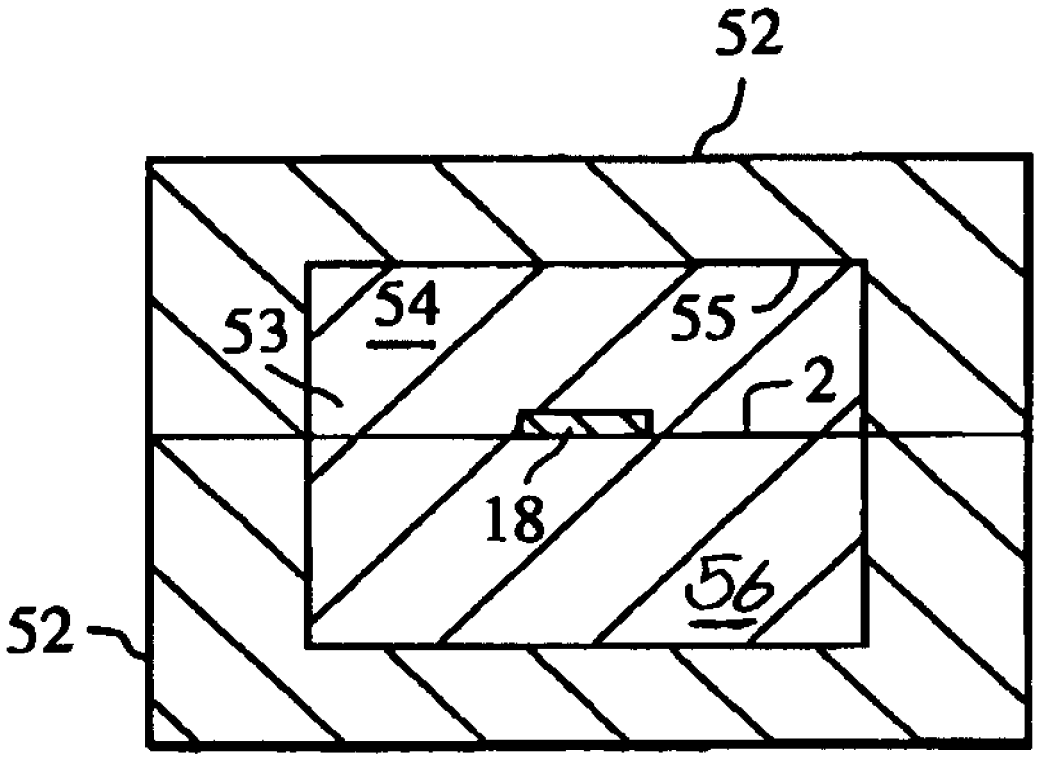

In exemplary embodiments, the power divider 1 may be implemented in a variety of different transmission line configurations including, for example, a channelized microstrip (FIG. 3A), channelized single sided air stripline or suspended substrate stripline (FIG. 3B), channelized inverted microstrip (FIG. 3C—shown inverted), channelized double sided air stripline or high "Q" air stripline (FIG. 3D), microstrip on a substrate (FIG. 3E) and dielectric stripline (FIG. 3F). In an exemplary embodiment, the power divider 1 may include a strip pattern 18 and a groundplane 5 arranged on a surface of a substrate 2.

In an exemplary embodiment, the power divider 1 may include a housing structure 51 (FIGS. 3A-3D). In an exemplary embodiment, the housing structure 51 may include at least a top portion 52 (FIGS. 3A-3D) and a bottom portion (FIGS. 3A, 3B and 3D) which sandwich the substrate 2.

In an exemplary embodiment, a wall surface 55 of at least one of the top portion 52 and/or bottom portion 53 may define a channel 54 (FIGS. 3A-3D). In an exemplary embodiment, the channel 54 may be an air cavity (FIGS. 3A-3D). In an alternate exemplary embodiment, the waveguide channel 54 may be filled with dielectric 56 (FIG. 3F). In an exemplary embodiment, the dielectric 56 may be a material with a dielectric constant the same as or less than the dielectric constant of material comprising the substrate 2.

In an exemplary embodiment, the housing structure 51, the top portion 52 and/or the bottom portion 53 may be metal, for example machined metal, and may be aluminum. In an alternate exemplary embodiment, the top portion 52 and bottom portion 53 may be metalized plastic. In an exemplary embodiment, the top portion 52 and bottom portion 53 may be connected to ground.

In exemplary embodiments, the air cavity or cavities 54 in an exemplary power divider are about 25 mils above or below the substrate, about 3/10 inch wide and extend at least about the length of the power divider 1 which, in an exemplary embodiment, may be within a range of about one-half to one inch long, although such exemplary dimensions are application and frequency dependent. The length of the power divider 1 may depend in part on the transmission line and routing topology employed in a particular embodiment or application. In an exemplary embodiment, the substrate 2 may be about 5 mils thick.

In the exemplary embodiment illustrated in FIG. 3D, a channelized double-sided air stripline or high "Q air stripline comprises a power divider with its corresponding stripline patterns 18 deposited on both sides of the substrate In an exemplary embodiment, each port 21, 22, 23 (FIG. 2) for the divider may be electrically connected to both the top and bottom corresponding strip pattern 18 such that the signal will be transmitted through both the top and bottom strip patterns at equal potential.

FIG. 3E illustrates a cross-sectional view of an exemplary embodiment of a power divider fabricated in microstrip, which includes a microstrip pattern 18 on one surface of a dielectric substrate 2 and a groundplane layer 66 on an opposing surface of the substrate 2. In an exemplary embodiment, the substrate may be about 0.06 inches thick.

FIG. 3F illustrates a cross-sectional view of an exemplary embodiment of a power divider fabricated in dielectric strip line. A conductor stripline pattern 18 is suspended in a dielectric 56 in a channel defined within housing structure 52.

Figure 4:
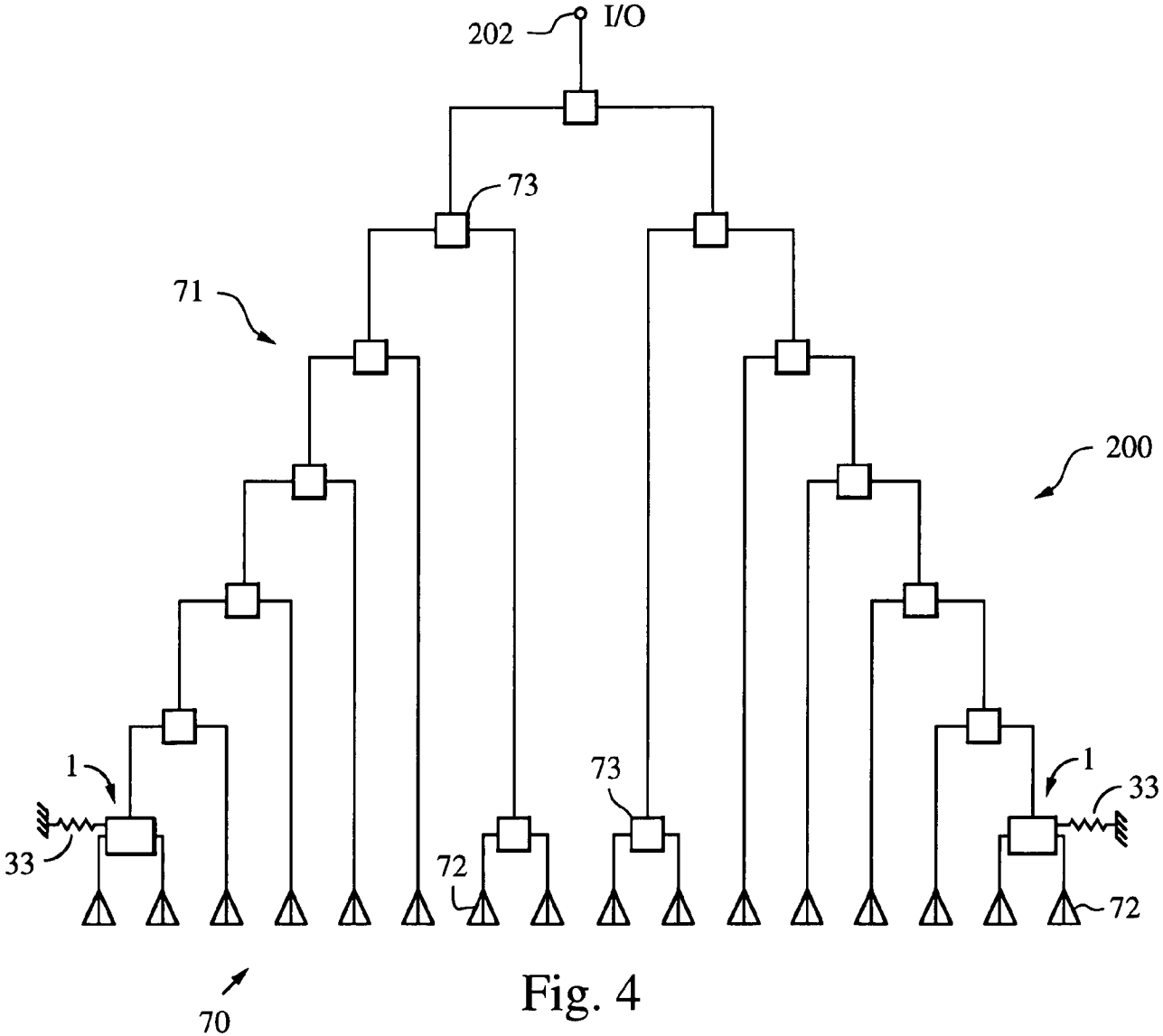
FIG. 4 illustrates a schematic diagram of an exemplary array system.

In an exemplary embodiment, an antenna or antenna sub-array may have a power distribution of element excitations across the aperture which is tapered. FIG. 4 illustrates a simplified schematic diagram of an antenna array 200 with an array 70 of radiating elements 72 connected to an I/O port 202 through a corporate feed network 71 In an exemplary embodiment, the array may be a sixteen-element array or sub-array. In an exemplary embodiment, the antenna array may include sixteen individual radiating elements 72 arranged in an array 70. In an exemplary embodiment, the feed network 71 may include a plurality of power dividers 73. In an exemplary embodiment, at least some of the power dividers 72 may be standard Wilkinson power dividers and others may be a power divider circuit 1 as described above regarding FIG. 1, with a termination resistor 33.

Figure 5:
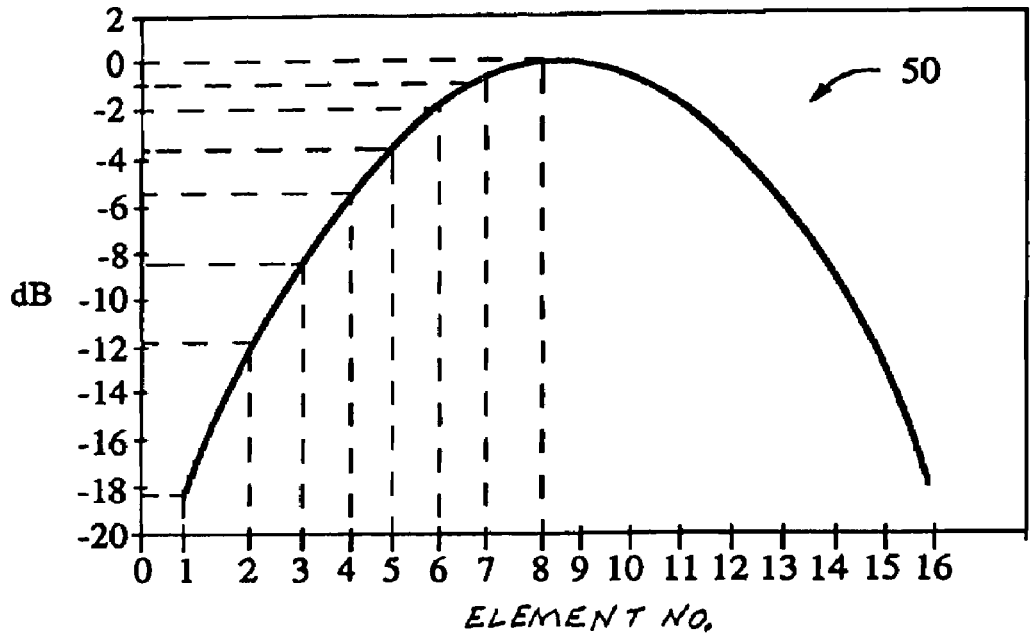
FIG. 5 illustrates an exemplary transmission power taper across an exemplary 16 element array or sub-array.
Figure 6:
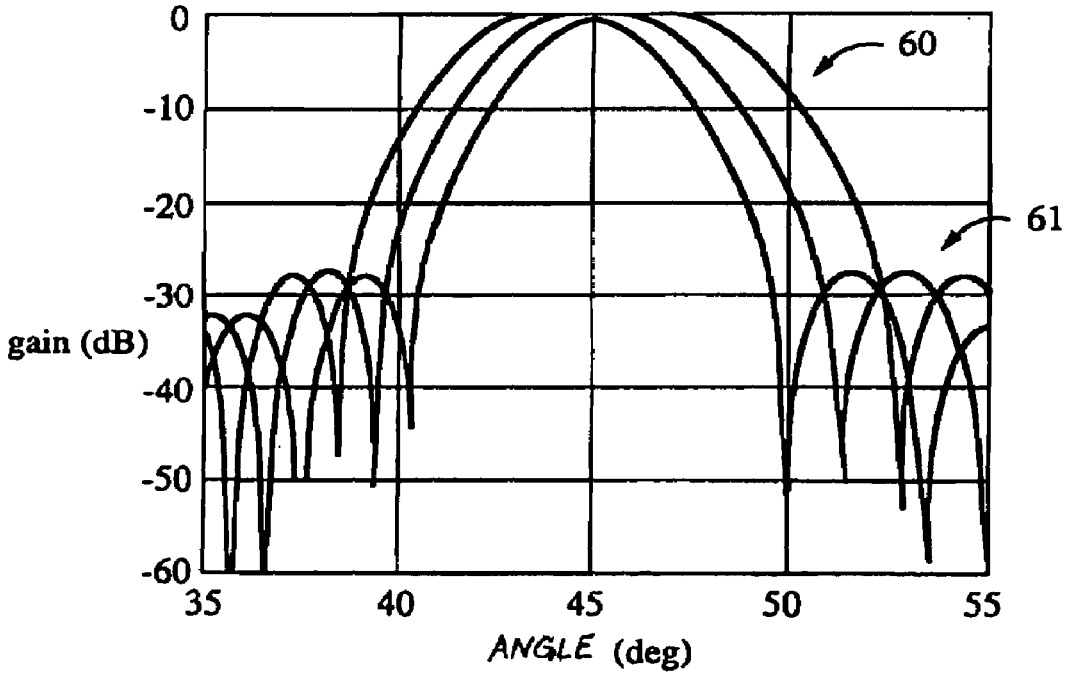
FIG. 6 illustrates an exemplary radiation pattern from an exemplary radar array.

FIG. 5 illustrates an exemplary taper 50 across an exemplary 16 element array, in which the power split between adjacent elements is progressively greater from the center to the outer edges. In an exemplary embodiment, the power amplitude distribution across a 16 element array may drop up to about an 18 dB drop from the center elements to the outer elements. In an exemplary embodiment, power divider circuits 1 may be employed between the last two elements at each end with unequal power split ratio of 6.3 dB may be employed to realize a maximum of −2.8 dB side-lobe levels in the antenna radiation pattern. FIG. 6 illustrates an exemplary antenna gain (in dB) radiation pattern 60 for a 16 element, tapered array or sub-array. The antenna gain radiation pattern may have side-lobe levels 61 of up to about −2.8 dB.

In an exemplary embodiment, a power divider with an exemplary 6.54 db power split ratio may have a good match and good isolation across a 10 GHz to 14 GHz frequency band.

It is understood that the above-described embodiments are merley illustative of the possible specific embodiments which may represent principle of the present invention. Other arrangements may readily be devised in accordance with these principles by those skilled in the art without departing from the scope and spirit of invention. The terms top and bottom and up and down are used herein for convenience to designate relative spatial relationships among various features in various embodiments.

What is claimed is:

1. An RF power divider circuit for unequally dividing an input signal into first and second signal components of unequal power, comprising:

a single input port;

first and second output ports;

a termination port, wherein the first and second output ports are separate and distinct from said termination port;

a combination of a plurality of quarter wave transformers and a plurality of resistors coupled between said input port, said termination port and said first and second output ports, said plurality of quarter wave transformers comprising a dielectric substrate and a conductor strip pattern formed on the dielectric substrate, wherein said combination of a plurality of quarter wave transformers and a plurality of resistors comprises:

a first quarter wave transformer connected between said input port and a first circuit node, a second quarter wave transformer connected between said first circuit node and a second circuit node, a third quarter wave transformer connected between said first circuit node and a third circuit node, a first resistive element connected between said second and said third circuit nodes, a second resistive element connected between said second circuit node and said termination port, a fourth quarter wave transformer connected between said termination port and a fourth circuit node, a fifth quarter wave transformer connected between said second circuit node and said fourth circuit node, a sixth quarter wave transformer connected between said fourth circuit node and said first output port, a seventh quarter wave transformer connected between said third circuit node and a fifth circuit node, and an eight quarter wave transformer connected between said fifth circuit node and said second output port; and a termination resistor connected between said termination port and ground, wherein an input signal at said input port propagates through said power divider circuit and said is divided into the first and second signal components at said first and second output ports and a termination signal component through said termination resistor.

2. The circuit of claim 1, wherein the power divider has a power split ratio of said first and second signal components of about 6.27 dB.

3. The circuit of claim 1, wherein said plurality of resistors are fabricated by printing the resistors onto the dielectric substrate.

4. The circuit of claim 1, wherein the power divider has a power split ratio of said first and second signal components in a range from about 3 dB to about 9 dB.

5. The circuit of claim 1, wherein the power divider has a power split ratio of said first and second signal components of greater than 3 dB.

6. The circuit of claim 1, wherein said circuit is fabricated as a channelized single sided air stripline.

7. The circuit of claim 1, wherein said circuit is a suspended substrate stripline circuit.

8. The circuit of claim 1, wherein the circuit comprises a channelized microstrip circuit.

9. The circuit of claim 1, wherein the circuit comprises a channelized double sided air stripline circuit.

10. An RF power divider circuit for unequally dividing an input signal into first and second signal components of unequal power, comprising:

a single input port;

first and second output ports;

a termination port;

a combination of a plurality of quarter wave transformers and a plurality of resistors coupled between said input port, said termination port and said first and second output ports, said plurality of quarter wave transformers comprising a dielectric substrate and a conductor strip pattern formed on the dielectric substrate, wherein said plurality of resistors are mounted on the dielectric substrate as discrete chips; and a termination resistor connected between said termination port and ground.

11. The circuit of claim 10, wherein said plurality of resistors are mounted on the dielectric substrate as discrete chips using a solder or conductive epoxy.

12. An RF power divider circuit for unequally dividing an input signal into first and second signal components of unequal power, comprising:

a single input port;

first and second output ports;

a termination port, wherein the first and second output ports are separate and distinct form said termination port;

a combination of a plurality of quarter wave transformers and a plurality of resistors coupled between said input port, said termination port and said first and second output ports, said plurality of quarter wave transformers comprising a dielectric substrate and a conductor strip pattern formed on the dielectric substrate, wherein the plurality of resistors have resistance values within a tolerance of about +/−20 percent; and a termination resistor connected between said termination port and ground, wherein an input signal at said input port propagates through said power divider circuit and said input signal is divided into the first and second signal components at said first and second output ports and a termination signal component through said termination resistor.

13. An antenna array comprising:

an array of radiating elements;

an input port;

a feed network coupling the input port to the array of radiating elements, the feed network arranged such that a power split between adjacent radiating elements is progressively greater from an array center to array outer edges, said feed network comprising a plurality of power dividers, wherein the plurality of power dividers comprises at least first and second outermost power dividers having power splits of greater than 5 dB;

wherein the first and second power dividers each are for unequally dividing an input signal at an input port into first and second signal components of unequal power at first and second output ports, and further comprise:

a termination port;

a combination of a plurality of quarter wave transformers and a plurality of resistors coupled between said input port, said termination port and said first and second output ports, said plurality of quarter wave transformers comprising a dielectric substrate and a conductor strip pattern formed on the dielectric substrate; and a termination resistor connecting said termination port to ground.

14. The array of claim 13, wherein said first and second outermost power dividers each comprise a Wilkinson power divider circuit portion, and an integrated distributed transmission line network functioning as an attenuator, said integrated distributed transmission line network comprising said termination resistor.

15. The array of claim 13, wherein the plurality of resistors have resistance values within a tolerance of about +/−20 percent.

16. A feed network for an antenna array, comprising:

a plurality of power dividers providing a tapered power distribution, wherein the plurality of power dividers comprises at least first and second outermost power dividers having power splits of greater than 5 dB, wherein the first and second power dividers each are for unequally dividing an input signal at an input port into first and second signal components of unequal power at first and second output ports, each of said first and second power dividers comprising:

a termination port;

a combination of a plurality of quarter wave transformers and a plurality of resistors coupled between said input port said termination port and said first and second output ports, said plurality of quarter wave transformers comprising a dielectric substrate and a conductor strip pattern formed on the dielectric substrate; and a termination resistor connecting said termination port to ground.

17. The network of claim 16, wherein the outermost power dividers each have a power split ratio of said first and second signal components of about 6.27 dB.

18. The network of claim 16, wherein the plurality of resistors have resistance values within a tolerance of about +/−20 percent.

* * * * *